US009584901B1

(12) United States Patent
Silvestri et al.

(10) Patent No.: US 9,584,901 B1
(45) Date of Patent: Feb. 28, 2017

(54) CONVERTIBLE HEADPHONE SYSTEM

(71) Applicant: Bose Corporation, Framingham, MA (US)

(72) Inventors: Ryan Christopher Silvestri, Franklin, MA (US); Mihir D. Shetye, Framingham, MA (US); Eric Matthew Wallace, Andover, MA (US); Eric Douglas Curtiss, Brighton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 14/846,871

(22) Filed: Sep. 7, 2015

(51) Int. Cl.
*H04R 25/00* (2006.01)
*H04R 1/28* (2006.01)
*H04R 1/10* (2006.01)

(52) U.S. Cl.
CPC ..... *H04R 1/2819* (2013.01); *H04R 1/1025* (2013.01); *H04R 1/1041* (2013.01); *H04R 1/28* (2013.01); *H04R 2205/021* (2013.01)

(58) Field of Classification Search
CPC ..... H04R 1/28; H04R 1/1025; H04R 1/1041; H04R 1/2819; H04R 2205/021
USPC ..... 381/370, 371, 373, 376, 383
See application file for complete search history.

(56) References Cited

U.S. PATENT DOCUMENTS

| | | | | |
|---|---|---|---|---|
| 1,469,899 | A | 10/1923 | Donnell | |
| 3,443,661 | A | 5/1969 | Van Sciver | |
| 4,041,256 | A | 8/1977 | Ohta et al. | |
| 5,181,252 | A | 1/1993 | Sapiejewski et al. | |
| 6,012,542 | A | 1/2000 | Accordino | |
| 6,104,819 | A * | 8/2000 | Nickum | H04R 1/1041 381/123 |
| 7,778,431 | B2 | 8/2010 | Feng et al. | |
| 8,483,420 | B2 | 7/2013 | Kim et al. | |
| 8,489,214 | B2 | 7/2013 | Shen et al. | |
| 2006/0256992 | A1 * | 11/2006 | Liao | H04R 1/1041 381/371 |
| 2008/0298623 | A1 * | 12/2008 | Klein | H04R 1/2857 381/380 |
| 2009/0169040 | A1 | 7/2009 | Chen et al. | |
| 2010/0067714 | A1 | 3/2010 | Cheng | |
| 2012/0237058 | A1 | 9/2012 | Salomaa et al. | |
| 2013/0177195 | A1 | 7/2013 | Sze et al. | |

FOREIGN PATENT DOCUMENTS

| | | |
|---|---|---|
| DE | 202007016881 U1 | 4/2009 |
| GB | 274576 | 7/1927 |

OTHER PUBLICATIONS

The International Search Report and the Written Opinion of the International Searching Authority mailed on Nov. 18, 2016 for corresponding PCT Application No. PCT/US20161050303.

* cited by examiner

*Primary Examiner* — Brian Ensey
(74) *Attorney, Agent, or Firm* — Brian M. Dingman; Dingman IP Law, PC

(57) ABSTRACT

A convertible headphone system with headphones having a transducer with a front and a rear, and a back cavity that is fluidly coupled to the rear of the transducer, and an external acoustic structure that defines an acoustic volume. The headphones and the external acoustic structure are configured to be coupled together so as to fluidly couple the back cavity of the headphones to the acoustic volume of the external acoustic structure, to form an expanded back cavity volume.

19 Claims, 13 Drawing Sheets

CONVERTIBLE HEADPHONE SYSTEM

BACKGROUND

This disclosure relates to headphones that can also be used as out-loud listening devices where they project sound into the surrounding environment.

Headphones are designed to efficiently deliver relatively low volumes of sound to the ears. If headphones could also be used to play music out loud, they would serve a dual purpose. However headphone drivers are usually highly compliant and headphones do not have much back cavity volume. Headphones thus are not able to produce low frequency sounds at sufficient volume to be useful as out-loud listening devices.

SUMMARY

All examples and features mentioned below can be combined in any technically possible way.

In one aspect, a convertible headphone system includes headphones having a transducer with a front and a rear, and a back cavity that is fluidly coupled to the rear of the transducer. There is an external acoustic structure that defines an acoustic volume. The headphones and the external acoustic structure are configured to be coupled together so as to fluidly couple the back cavity of the headphones to the acoustic volume of the external acoustic structure, to form an expanded back cavity volume.

Embodiments may include one of the following features, or any combination thereof. The external acoustic structure may comprise a headphone case that is constructed and arranged to stow the headphones, wherein the headphone case has an interior volume that comprises the acoustic volume. The convertible headphone system may further include a movable structure that is coupled to the headphones and in part defines the rear cavity, wherein the movable structure is constructed and arranged to be moved so as to alter the configuration of the rear cavity. The headphone case may comprise a mechanical device that is constructed and arranged to engage with and move the movable structure when the headphones are stowed in the headphone case. The mechanical device of the headphone case may comprise protruding features that engage with and move the movable structures when the headphones are stowed in the headphone case. The protruding features may comprise posts. The case may comprise a lower portion in which the headphones sit when stowed, where the lower portion has a lower wall, and wherein the posts protrude into the interior volume of the case from the lower wall.

Embodiments may include one of the above and/or below features, or any combination thereof. The headphones may comprise two ear cups and the headphone case may have two openings, wherein each of the openings is aligned with one of the ear cups when the headphones are stowed in the case. The openings can be misaligned with the earcups as long as there is an acoustic path from the earcups to the openings. For example, tubes or other structures may acoustically connect the earcups to the openings. When the headphones are stowed in the case the ear cups may seal to the case around the openings. The headphone case may comprise an audio port that comprises an opening from the interior volume of the headphone case to the outside.

Embodiments may include one of the above and/or below features, or any combination thereof. The headphones may further include a shell that is spaced from the rear of the transducer and defines part of the rear cavity. The shell may be constructed and arranged to slide in and out relative to the transducer, so as to vary the volume of the rear cavity. The external acoustic structure may comprise a docking station. The headphones may comprise a rechargeable battery, and the docking station may comprise a battery charger and/or a battery that can be electrically coupled to the headphones, so that it can recharge the headphone battery when the headphones are coupled to the docking station. The headphones may comprise circumaural earpads that are adapted to fit over the ears, or supra-aural earpads that are adapted to sit on the ears.

Embodiments may include one of the above and/or below features, or any combination thereof. The transducer may comprise a driver that has a compliance that is equivalent to an approximate volume of air, and in the altered configuration the rear cavity may have approximately the same volume as the transducer compliance. The transducer may comprise a driver that has a compliance that is equivalent to a volume of approximately 250 cc of air. The transducer may comprise a driver that has a compliance that is equivalent to a volume of from about 75 cc to about 750 cc of air. The expanded back cavity volume may be from about 75 cc to about 750 cc. A ratio of the driver compliance to the expanded back cavity volume may be from about 0.5 to about 2.

In another aspect a convertible headphone system includes headphones comprising two ear cups, each with a transducer that has a front and a rear, wherein a rear cavity is fluidly coupled to the rear of each transducer, two movable structures that are coupled to the headphones such that they in part define the rear cavities, wherein the movable structures are constructed and arranged to be moved so as to alter the configuration of the rear cavities, and a headphone case that has an interior acoustic volume and is constructed and arranged to stow the headphones. The headphone case comprises mechanical devices that are constructed and arranged to engage with and move the movable structures when the headphones are stowed in the headphone case, so as to fluidly couple the rear cavities to the interior acoustic volume of the headphone case to create an expanded back cavity. Each transducer includes a driver that has a compliance that is equivalent to a volume of from about 75 cc to about 750 cc of air. A ratio of the driver compliance to the expanded back cavity volume is from about 0.5 to about 2.

In another aspect a convertible headphone system includes headphones comprising two ear cups that each have an earpad, wherein the earpads are either circumaural earpads that are adapted to fit over the ears or supra-aural earpads that are adapted to sit on the ears, wherein each ear cup comprises a transducer that has a front and a rear, wherein a rear cavity is fluidly coupled to the rear of each transducer, and two movable valves, one coupled to each ear cup such that the valves in part define the rear cavities, wherein the movable valves are constructed and arranged to be moved so as to alter the configuration of the rear cavities. Each transducer comprises a driver that has a compliance that is equivalent to an approximate volume of air, and wherein in the altered configuration the rear cavities have approximately the same volume as the transducer compliance. There is a headphone case that has an interior acoustic volume and is constructed and arranged to stow the headphones. The case comprises devices that are constructed and arranged to engage with and move the valves when the headphones are stowed in the headphone case, so as to fluidly couple the rear cavities to the interior acoustic volume of the headphone case to create an expanded back cavity. Each transducer comprises a driver that has a compliance that is equivalent to a volume of from about 75 cc to about 750 cc of air, and wherein a ratio of the driver compliance to the expanded back cavity volume is from about 0.5 to about 2.

DETAILED DESCRIPTION

The convertible headphone system has on-ear or over-ear headphones that deliver high-quality sound to the ears. The headphones can be coupled to an external structure in such a manner that the back cavities of the headphone transducers are substantially enlarged. This results in the transducers efficiently generating low frequency sounds, so that the headphones can also be used as an out-loud listening device.

Figure 1A:
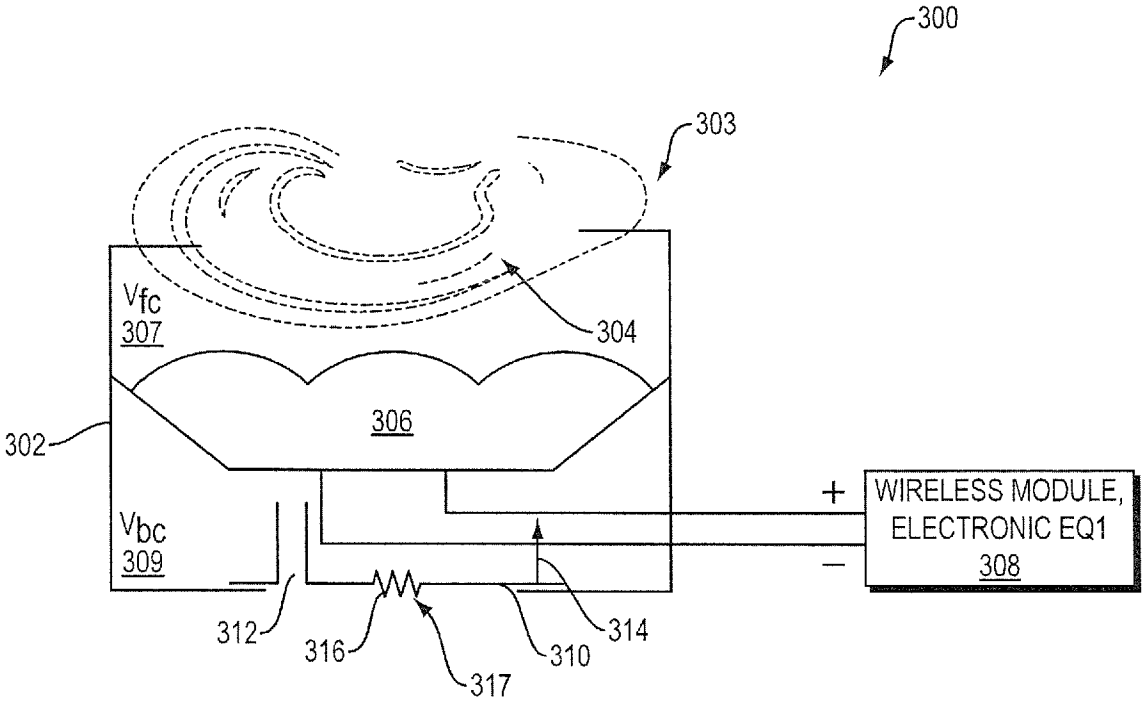
FIG. 1A is a highly schematic representation of a convertible headphone system in use as headphones.
Figure 1B:
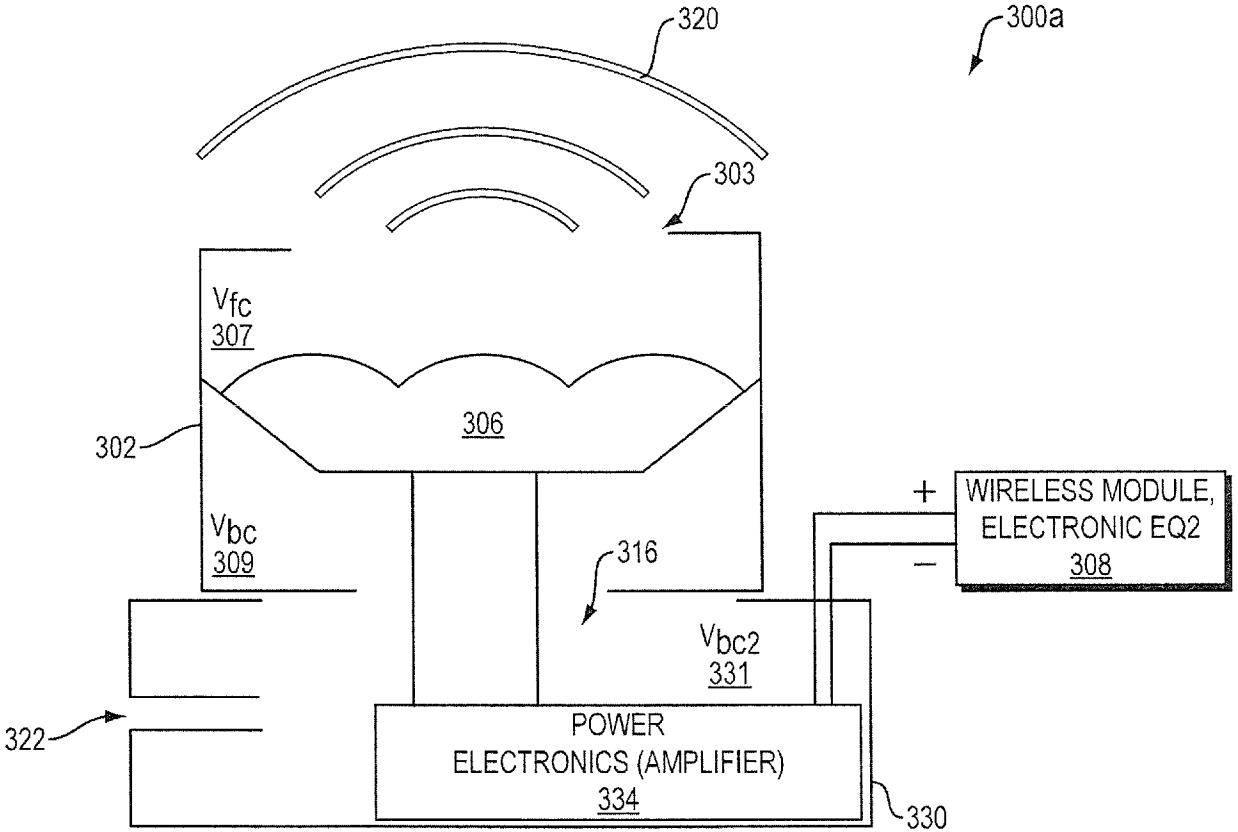
FIG. 1B is a highly schematic representation of the convertible headphone system of FIG. 1A in use as an out-loud listening device.

FIGS. 1A and 1B conceptually illustrate convertible headphone system 300 according to this disclosure. Earcup 302 with sound-emitting opening 303 sits on the head, on or over ear pinna 304. Transducer 306 provides sound into front cavity 307, which has volume $V_{fc}$, and back or rear cavity 309, which has volume $V_{bc}$. Earcup 302 has rear openings or ports 317 and 312 that are selectively decoupled from back cavity 309 by movable structure 310. Rear ports 317 and 312 enable the tuning of the frequency response of system 300. Rear port 317 is a resistive port that may be made by placing a resistive mesh 316 over an opening in the back of the earcup, or in another manner known in the art. Rear port 312 is a mass port that may be making a long tube connected to the back of the earcup, or in another manner known in the art. The earcup can have none, one, or multiple ports in the back cavity. The earcup can be constructed using multiple combinations of porting elements; some embodiments can include a resistive port, or a mass port, or both in parallel, or no ports. Wireless/equalization module 308 provides electrical signals that drive transducer 306. Module 308 could also be hard wired to the transducer.

Earcup 302 is configured to be coupled to an external acoustic structure in such a manner that back cavity 309 is fluidly coupled to an acoustic volume in the acoustic structure. This is illustrated in FIG. 1B, where opening 316 of earcup 302 is depicted fluidly coupled to internal acoustic volume 331 (with volume $V_{bc2}$) of separate dock or headphone case (i.e., an acoustic structure) 330. Note that with typical headphones that include a driver for each ear this external acoustic volume 331 can be shared by both headphone drivers, or each driver can have its own separate external acoustic volume. Structure 330 has port 332 that allows sound to escape from it. An alternative to a port could be a passive radiator. Amplifier 334 is operably coupled to module 308 so as to be able to drive transducer 306 at levels that are sufficient to emit sound 320 from front opening 303 as well as rear port 332. The volume of the expanded back cavity, which is formed by back cavity 309 and internal acoustic volume 331 together, is better able to reproduce lower frequency sounds than is back cavity 309 alone. A result is that the coupled system 300*a* can be used as an out-loud listening device.

Figure 2A:
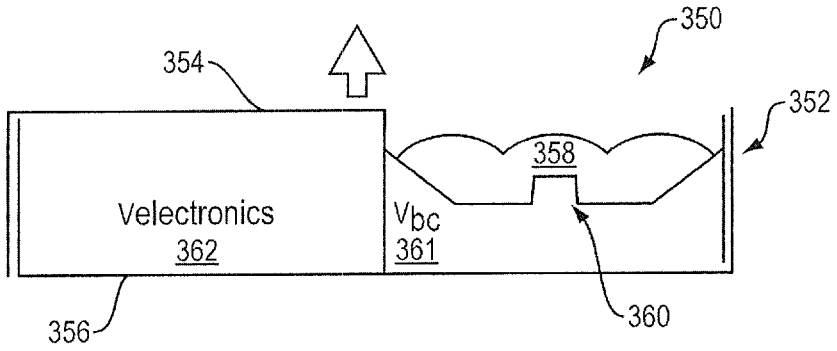
FIG. 2A is a highly schematic representation of another convertible headphone system in use as headphones.
Figure 2B:
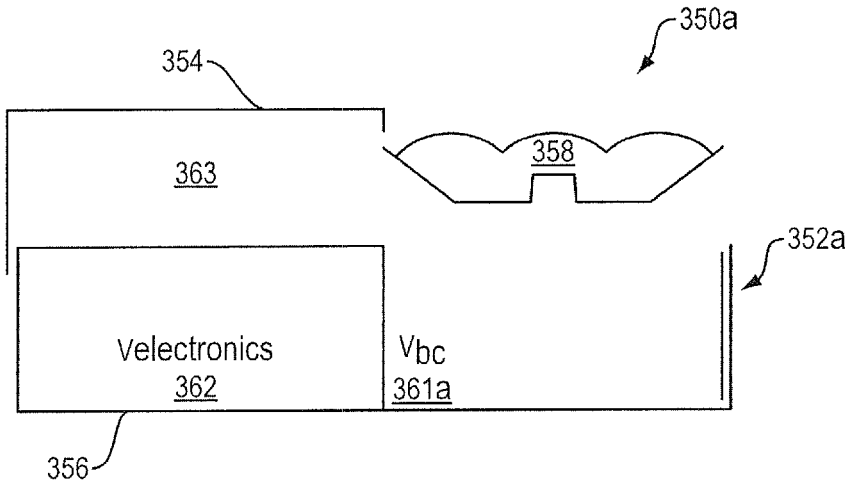
FIG. 2B is a highly schematic representation of the convertible headphone system of FIG. 2A in use as an out-loud listening device.

Another conceptual example of a convertible headphone system 350 is shown in FIGS. 2A and 2B. In this example the increased back cavity volume is accomplished without a separate acoustic structure. Instead, back cavity 361 of headphone 352 is itself made expandable by constructing the front 354 and rear 356 earcup portions to slide in and out relative to one another. The nested configuration of FIG. 2A is the compact, on-head configuration, while when portions 354 and 356 are moved apart to the out-loud listening configuration 352*a* of FIG. 2B, back cavity volume 361*a* is greater than volume 361, while additional volume 363 is also created; volume 363 is fluidly coupled to volume 361*a* to create a larger expanded back cavity volume, similar to that accomplished in the configuration of FIG. 1. Electronics module 362 drives transducer 358 in both the on-head and out-loud configurations.

In order for the headphone system to be used as an out loud listening device, the back or rear cavity volume is substantially increased such that low-frequency sounds are much more efficiently generated at loud volumes sufficient for the system to act like a standalone music player with dedicated loudspeakers. At the same time, that headphone transducers need to appropriately deliver sound to the ears of the user when they are used as headphones, and worn. High-performance headphones usually have drivers that are lightweight, highly compliant and small in size, while the drivers for out-loud speakers are typically heavy, stiff and large. Accordingly, the drivers for headphones and out loud listening are typically mutually exclusive in design.

For the present convertible headphone system, it is helpful to design the drivers such that they perform well both as on-head and out-loud speakers. In one non-limiting embodiment of the subject convertible headphone system, the compliance of the transducer drivers is designed to be approximately the same as the volume of the expanded rear cavity, when the headphones are coupled to the external acoustic structure. In one non-limiting example, the expanded back cavity volume is about 250 cc and the headphone drivers have a compliance that is equivalent to a 250 cc volume of air. It is believed that the range of the compliance of the driver should be from about 75 cc to about 750 cc, that the range of headphone back cavity volume should be from about 1 cc to about 100 cc per driver, and that the range of the expanded total back cavity volume should be from about 75 cc to about 750 cc. The ratio of driver compliance to expanded back cavity volume per driver should be from about 0.5 to about 2; ratios greater than about 2 would require more power than is feasible, and ratios less than 0.5 would require expanded back cavity volumes that are not feasible. Designing the port such that it resonates with the back cavity volume also constrains this ratio—as the ratio increases the efficiency by which the driver inputs energy into the port decreases, thus limiting the low frequency output required for equalizing. Also, the port becomes less efficient at enhancing the audio signal at its designed system resonance.

Figure 3A:
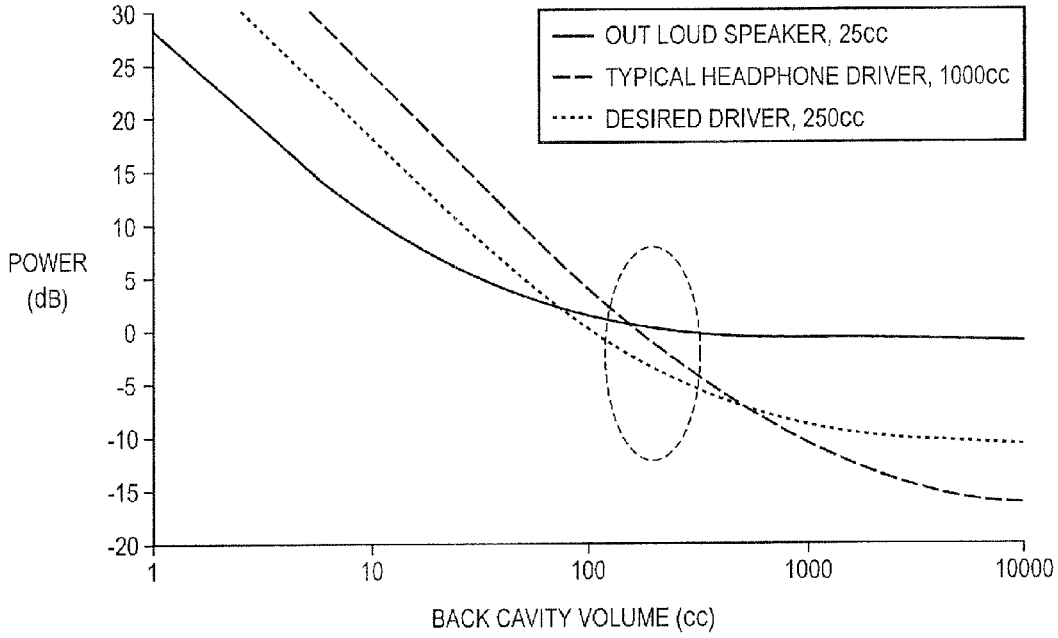
FIG. 3A illustrates power performance curves for drivers with three different compliances.
Figure 3B:
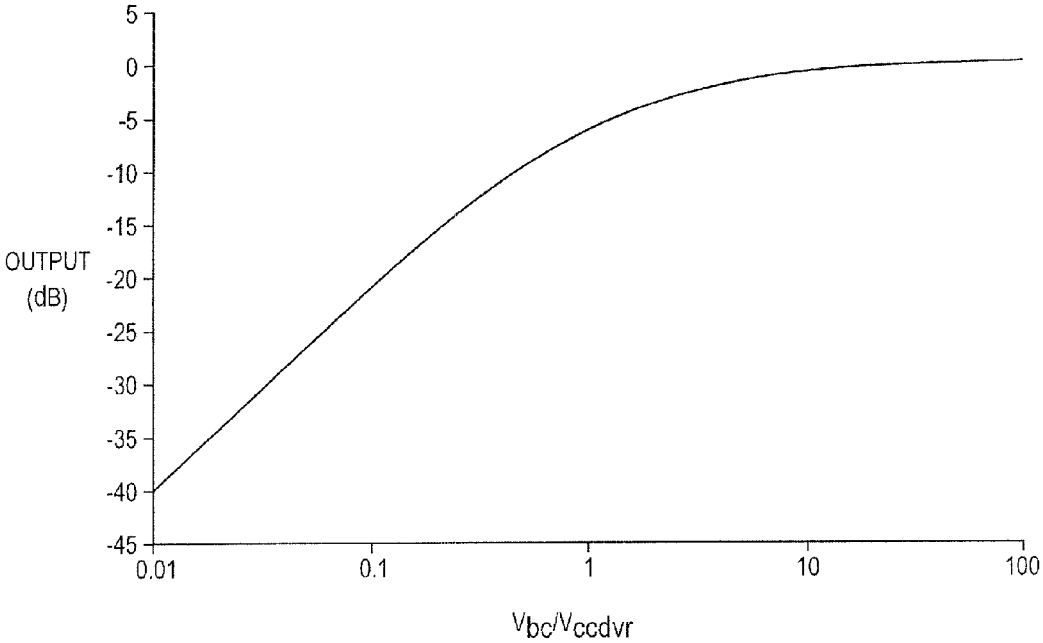
FIG. 3B illustrates the efficiency of different combinations of driver compliances and headphone back cavity volumes.

FIG. 3A illustrates the power for ranges of back cavity volumes for three different drivers. One is an out loud speaker with a compliance of 25 cc, another is a typical headphone driver with a compliance of 1000 cc, and the third is the driver described above with the compliance of about 250 cc (or, in the range of about 75 to about 750 cc). As can be seen, when the expanded back cavity volume is in the range from about 80 to about 500 cc, the 250 cc driver is most efficient. FIG. 3B illustrates the ratio of the expanded back cavity volume to the driver compliance showing that with the illustrated design where the ratio is about one, the output is in an acceptable range. The apparent volume of the transducer back cavity and/or of the expanded back cavity volume can be increased by including an air adsorber in the transducer back cavity and/or in the external acoustic volume, as is known in the art. Non-limiting examples of air adsorbers that can be employed herein are disclosed in U.S. Pat. Nos. 8,687,836 and 8,794,373, the disclosures of which are incorporated herein by reference.

Figure 4:
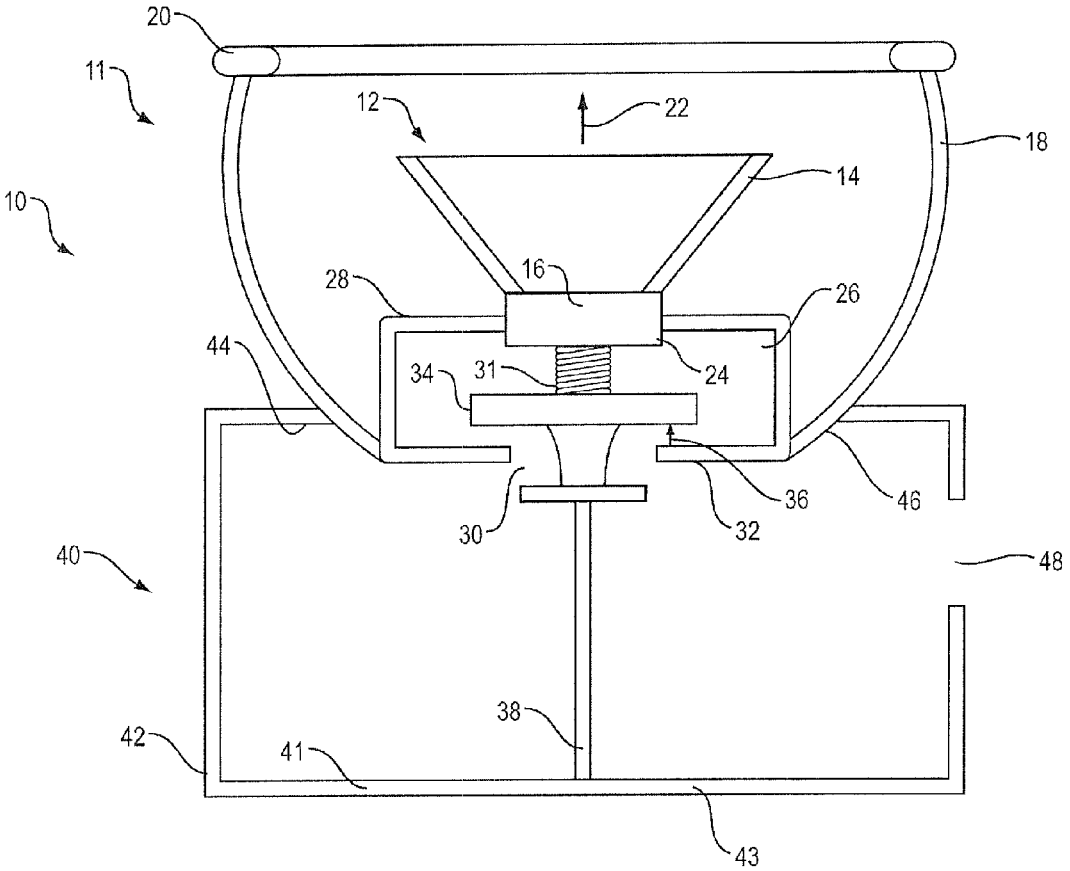
FIG. 4 is schematic representation of a convertible headphone system.

FIG. 4 is a schematic representation of a convertible headphone system 10 of this disclosure. Convertible headphone system 10 comprises headphones 11 which include transducer 12. Transducer 12 includes magnet 16 and diaphragm 14. Transducer 12 projects sound from its front side, in the direction of arrow 22. Sound leaves the front opening of headphone housing 18 that is circumscribed by ear cushion 20. A rear cavity 26 is defined behind the rear 24 of transducer 12. Cavity 26 is formed by enclosure 28 with rear wall 32 that has sound emitting opening 30. Opening 30 is selectively closed by movable structure 34 that in the closed position (not shown) sits against wall 32 and thus closes opening 30. In the open position shown in FIG. 4, movable structure 34 is located above wall 32; this allows sound to escape from rear cavity 26 through opening 30.

System 10 further includes an external acoustic structure 40 that defines an internal acoustic volume 41. Headphones 11 are configured to be coupled to external acoustic structure 40 so as to fluidly couple rear cavity 26 in its altered, open configuration shown in FIG. 4, to acoustic volume 41 of structure 40. Structure 40 may be defined by upper wall 44, sidewall 42, and lower wall 43. Structure 40 thus adds its acoustical volume 41 to the acoustical volume of back cavity 26. With a larger back cavity volume the transducer driver is able to be much more efficient in producing low-frequency at loud volumes, as is further described below. Sidewall 42 may have an opening 48 through which sound can travel to the environment.

Movable structure 34 can be constructed and arranged to be moved in a desired fashion. In the example shown in FIG. 4, structure 34 is moved to the open position when headphones 11 are placed into receiving opening 46 in upper wall 44 of external acoustic structure 40. Structure 40 includes fixed post 38 that sits in opening 46 such that when headphone housing 18 is seated in opening 46 as shown in FIG. 4, movable structure 34 contacts the top of post 38 and is pushed upward above wall 32 is indicated by arrow 36. Preferably there is some arrangement to return structure 34 to the closed position when headphones 11 are lifted off of structure 40. This is schematically illustrated by return spring 31 that can be accomplished in other fashions as would be apparent to those skilled in the field.

Figure 5:
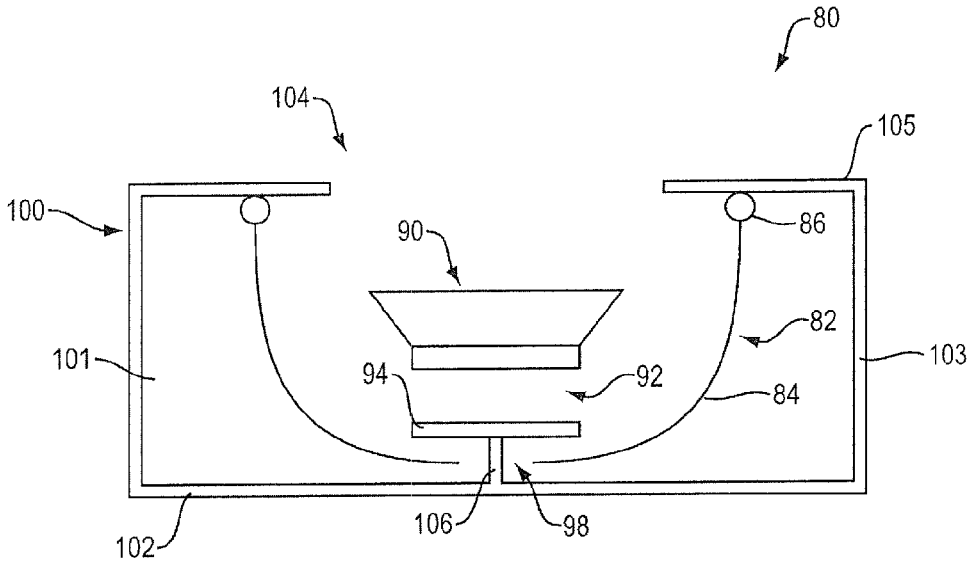
FIG. 5 is schematic representation of a convertible headphone system.

Another example of a convertible headphone system 80 of the present disclosure is schematically depicted in FIG. 5. Note that some details such as the back cavity divider or wall are not shown, for the sake of clarity. In this example, headphones 82 are constructed and arranged to be received (stowed) within headphone case 100. When they are, movable structure 94 is pushed upward off of rear opening 98 in headphone housing 84 by engaging with post 106 that projects inwardly from case bottom wall 102. This thereby increases the volume of rear cavity 92 to include the interior volume 101 of headphone case 100. Also illustrated in FIG. 5 is the substantial sealing of the front cavity of the headphones to the headphone case so that sound projected from the front of transducer 90 can escape through opening 104 in headphone case upper wall 105. In this non-limiting example, this sealing is accomplished with a physical arrangement in which ear cushion 86 is in contact with the inside of upper wall 105 when the headphones are placed into the case as shown in the drawing. This sealing also closes headphone case internal volume 101, except for any ports that are present.

Figure 6:
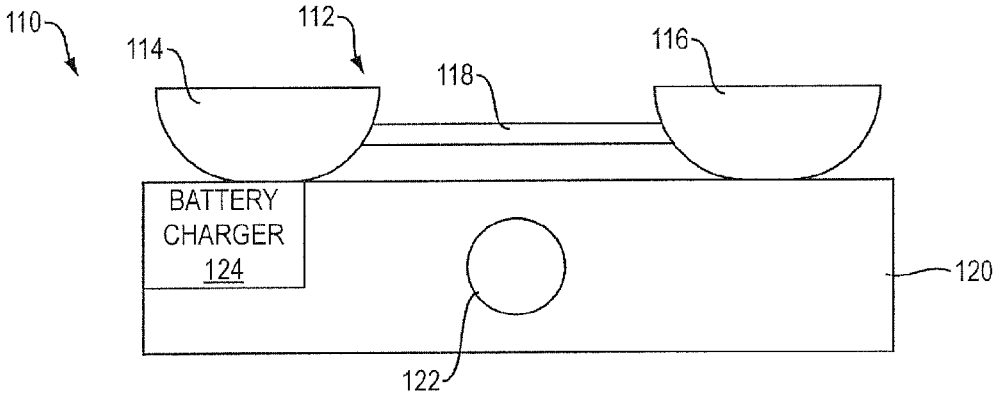
FIG. 6 is schematic representation of a convertible headphone system that includes a battery charger for wireless headphones.

Most headphones include two separate transducers, each of which is designed to provide sound to one ear of the user. The headphones can include circumaural ear cups that are adapted to fit over the ears, or supra aural ear cups that are adapted to sit on the ears. An example of a circumaural or supra-aural headphone 112 is depicted in FIG. 6. Headphones 112 comprise ear cups 114 and 116 connected by headband 118. Convertible headphone system 110 further includes external acoustic structure 120 that defines an internal acoustic volume. Headphones 112 are configured to be coupled to structure 120 so as to fluidly coupled the rear cavities of the transducers in ear cups 114 and 116 to the acoustic volume inside of structure 120. Opening 122, which may be the external opening of a port that is built into structure 120, allows sound to escape structure 120. Structure 120 may be configured to carry a battery charger 124 and/or a battery that functionally engages with headphones 112 when the headphones are coupled to structure 120 (e.g., via mating electrical contacts) so that any rechargeable batteries in headphones 112 are automatically charged when headphones are coupled to structure 120. Structure 120 may in one non-limiting example be a docking station for wireless headphones, wherein the docking station includes battery charge functionality that is designed to charge the battery of the headphones. By coupling the rear cavities of the headphone transducers to the available interior volume of docking station 120, the interior volume of docking station 120 helps system 110 to more efficiently produce low-frequency sound at relatively high volume. One result is that the convertible headphone system of the present disclosure allows headphones to be used in a configuration in which they provide high quality out loud listening acoustics, especially at lower frequencies.

Figure 7A:
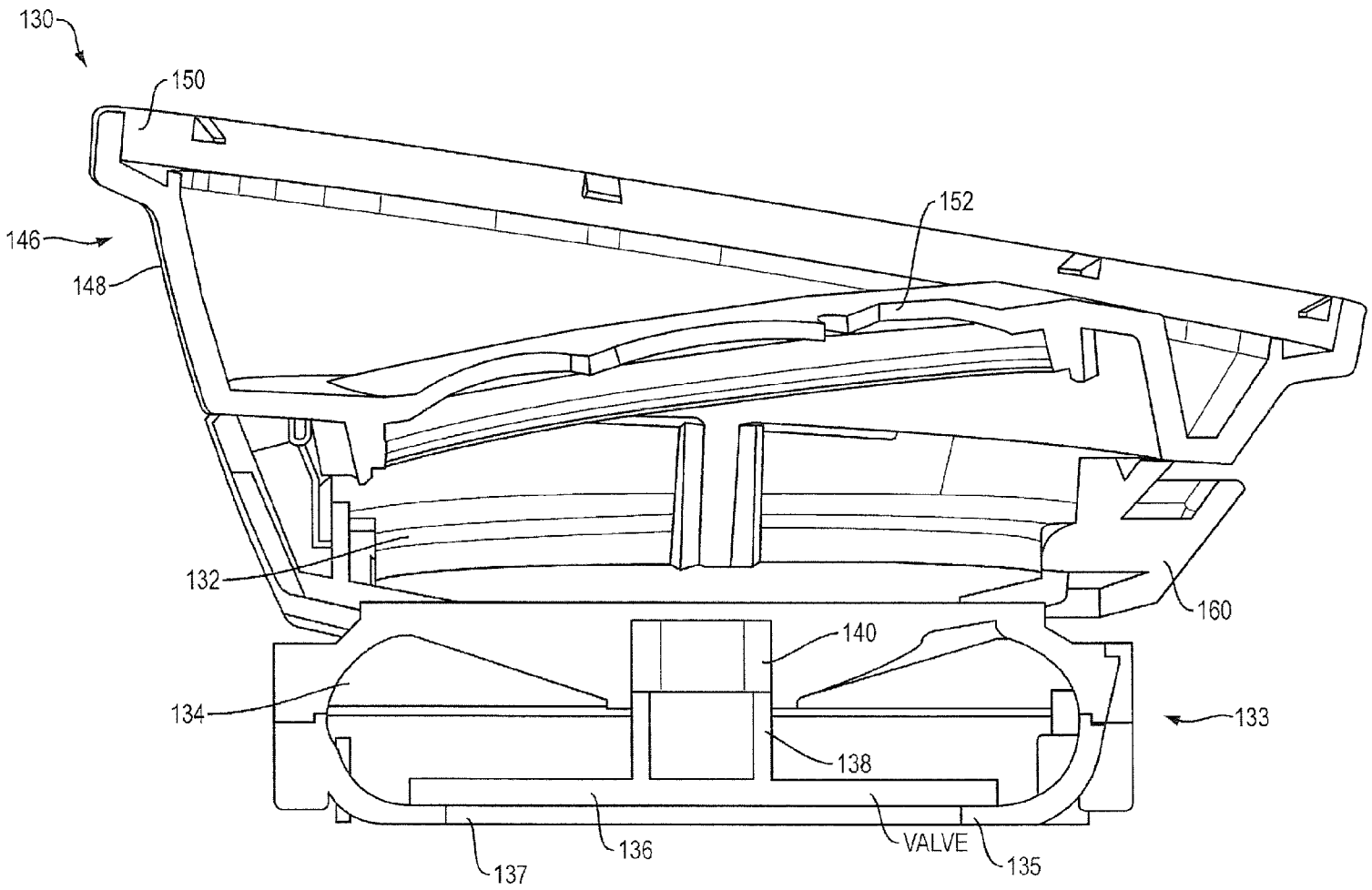
FIGS. 7A and 7B are cross-sectional and side views, respectively, of an ear cup for headphones for a convertible headphone system.
Figure 7B:
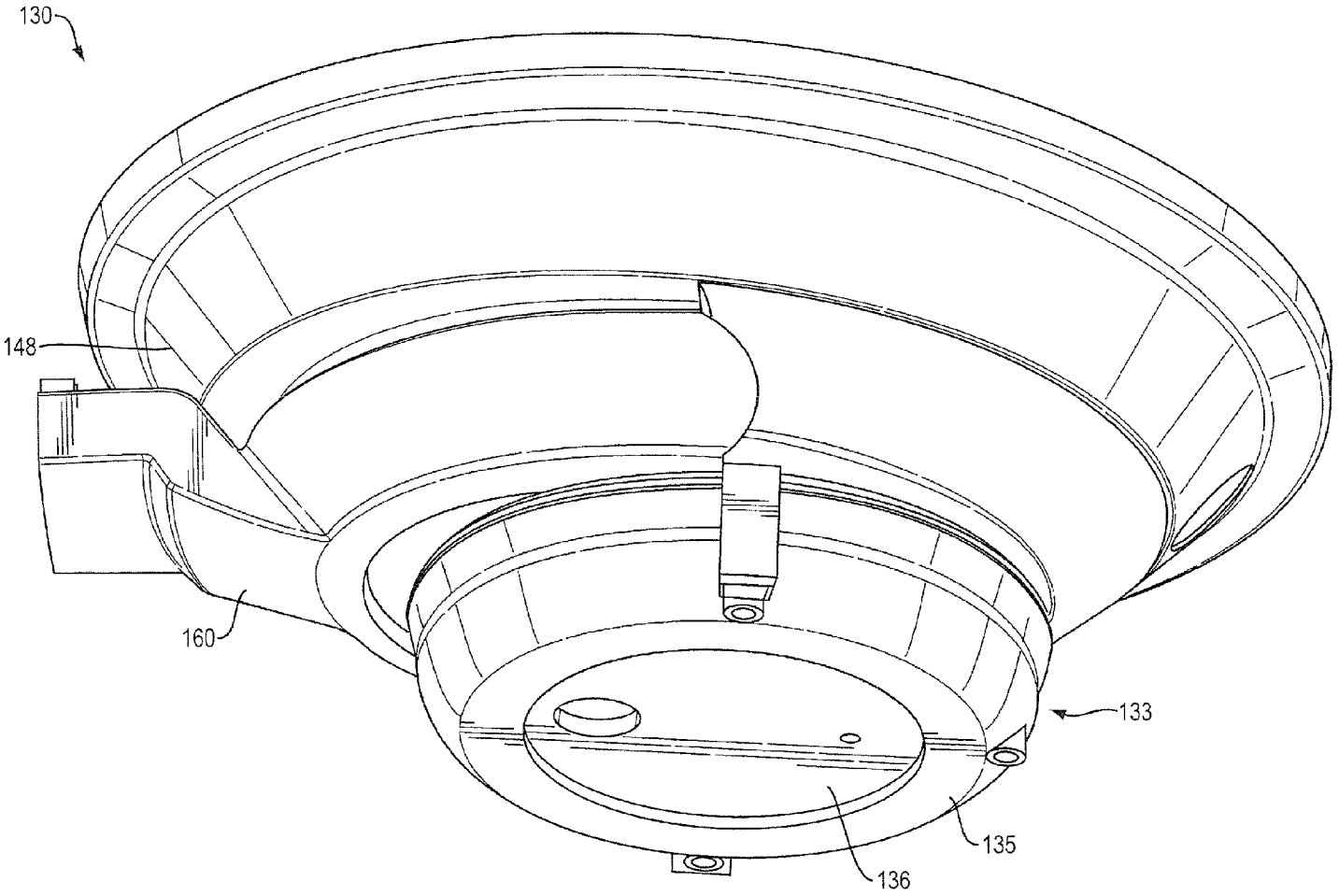
Figure 8A:
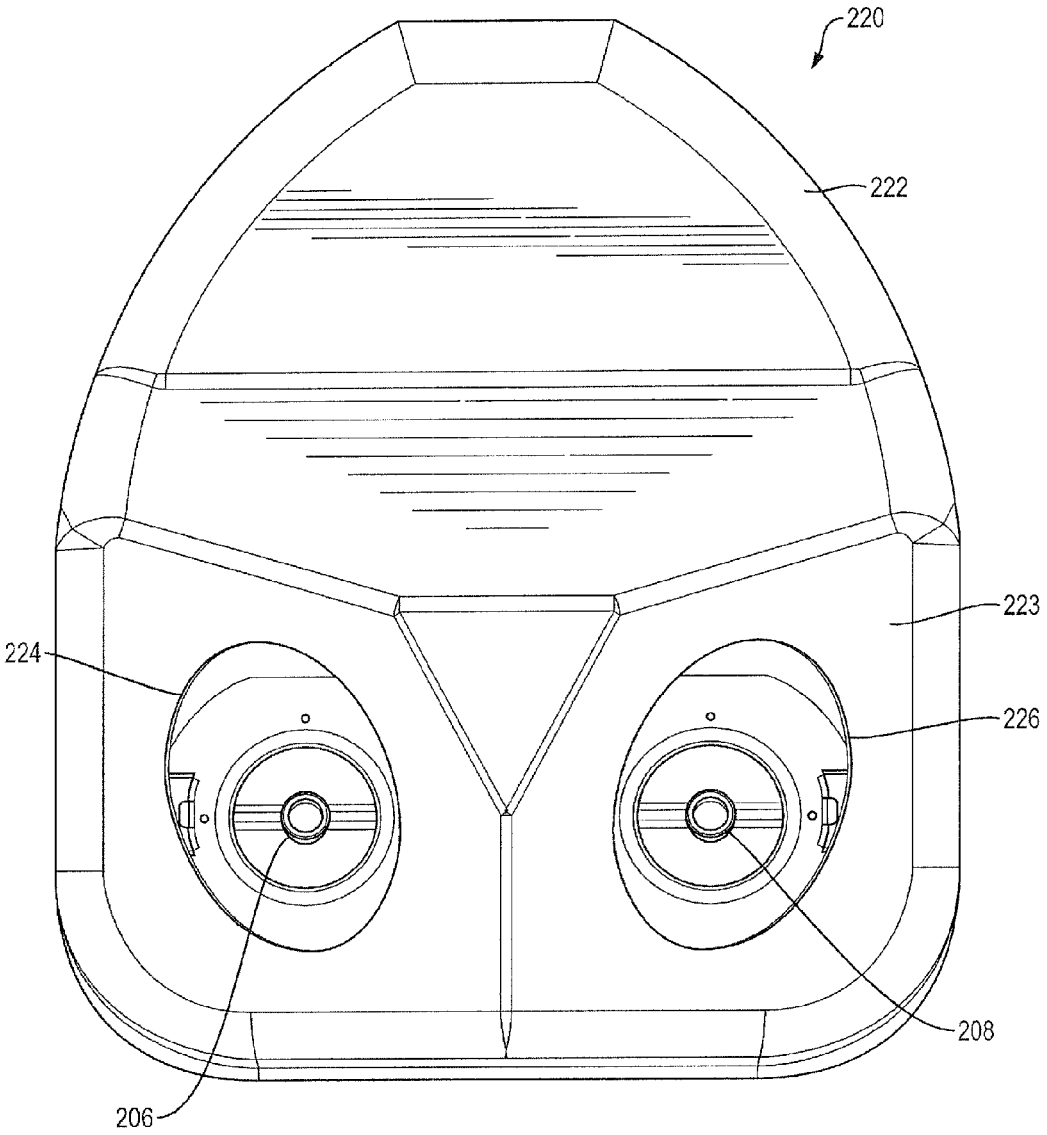
FIGS. 8A, 8B, 9A, 9B and 9C together illustrate a convertible headphone system that includes a headphone case.
Figure 8B:
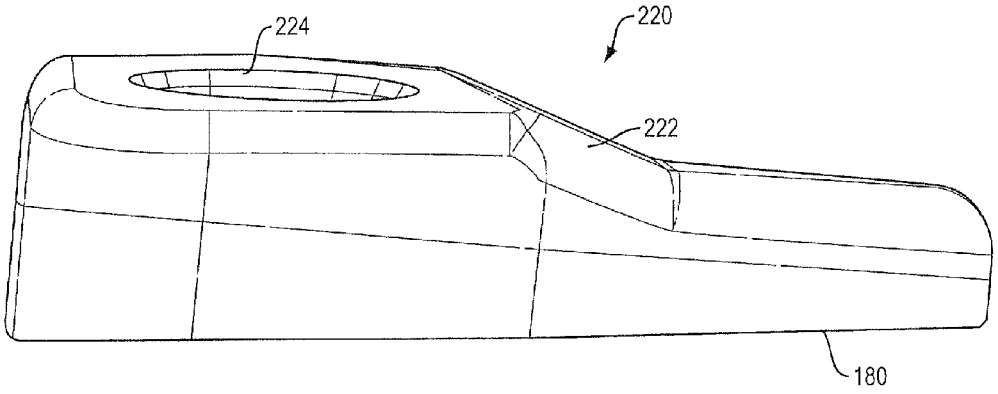

FIGS. 7A and 7B illustrate an example of headphones that can be used in a convertible headphone system of the present disclosure. Headphones 130 comprise ear cup 146 with upper housing 148 that defines channel 150 that holds an ear cushion (not shown), and screen 152 with openings that make screen 152 sufficiently acoustically transparent so that sound can be delivered from transducer 132 to an ear. The lower housing 133 defines rear transducer cavity 134 and has lower wall 135 with opening 137 that is selectively closed by movable structure or valve 136. Valve 136 has post 138 that is captured in and can move up and down within cylindrical cavity 140 in the upper part of housing 133. When valve 136 is moved from the closed position shown in FIG. 7A and pushed upward to an open position, opening 137 is exposed. When headphones 130 are coupled to an external acoustic structure such as those shown above, and when opening 137 is exposed by the valve being in the open position, the volume of the rear transducer cavity is increased as described above. Headphones 130 also includes structure 160 that engages a headband. In a typical arrangement, headphones would include two of the ear cups 146, one for each ear. However, headphones may comprise a single ear cup.

Figure 9A:
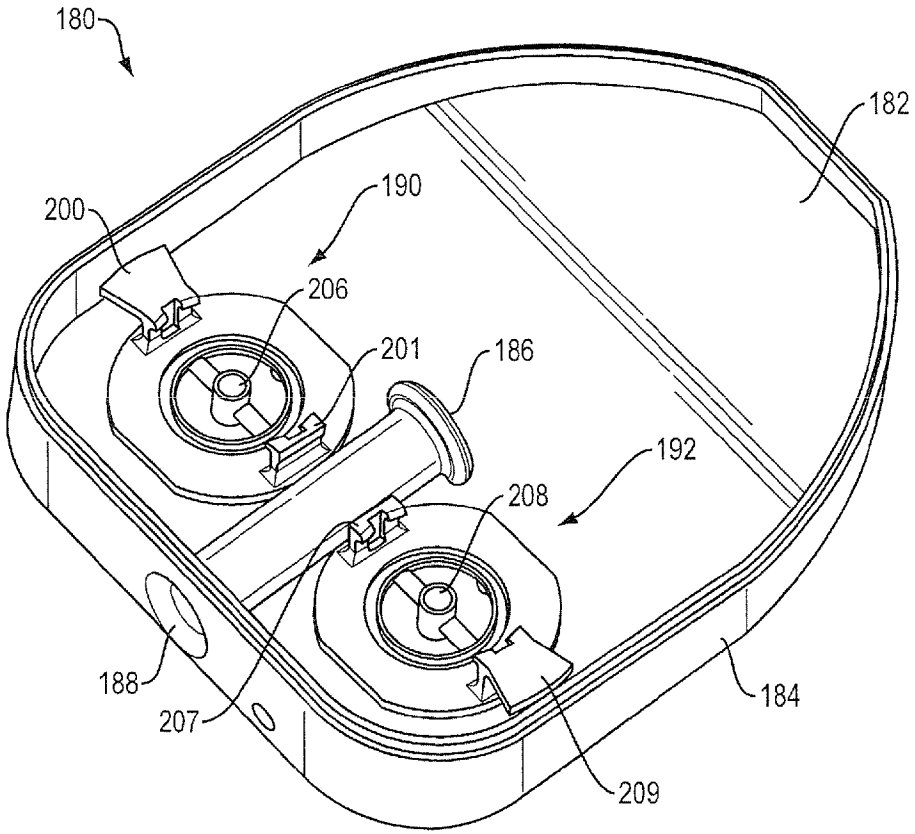
Figure 9B:
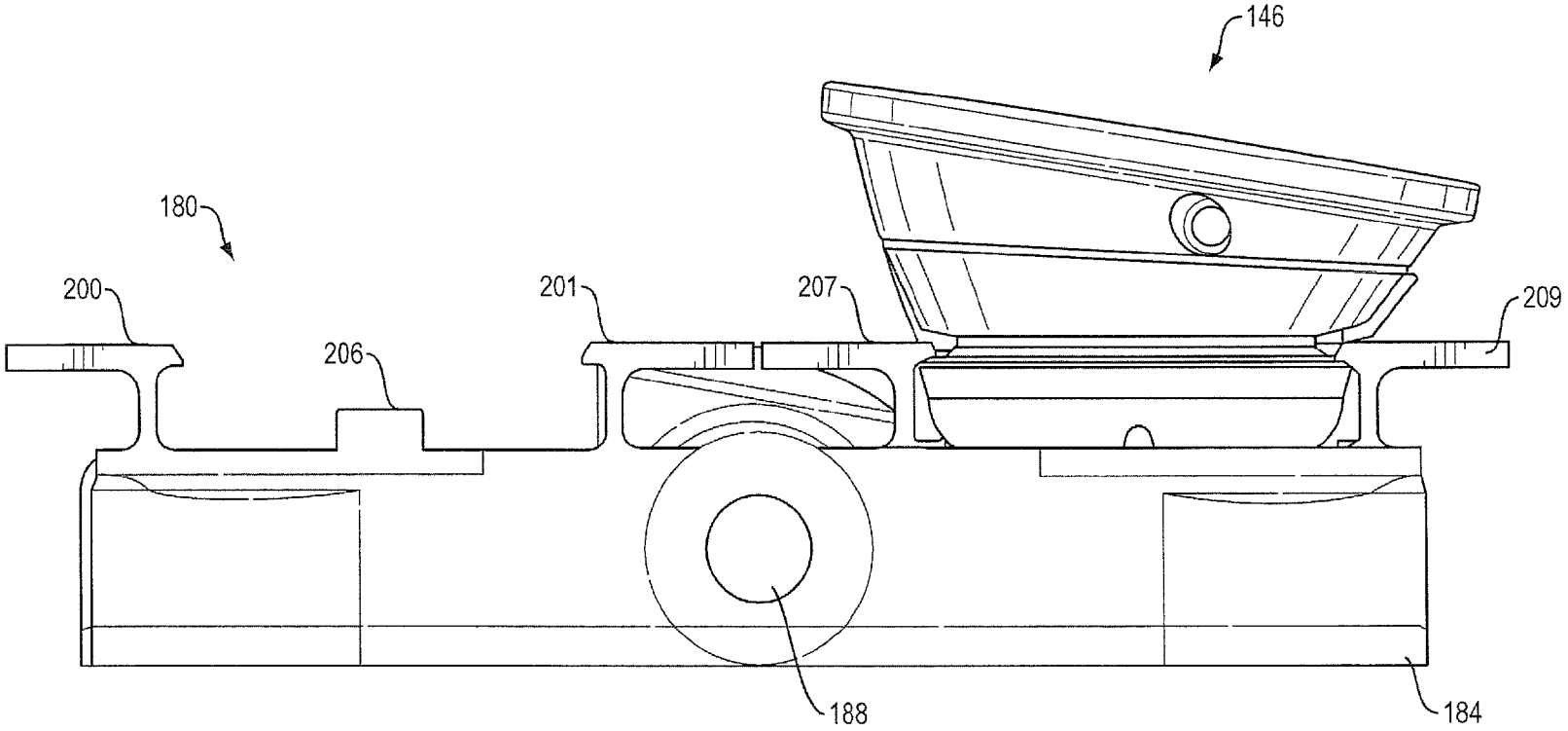
Figure 9C:
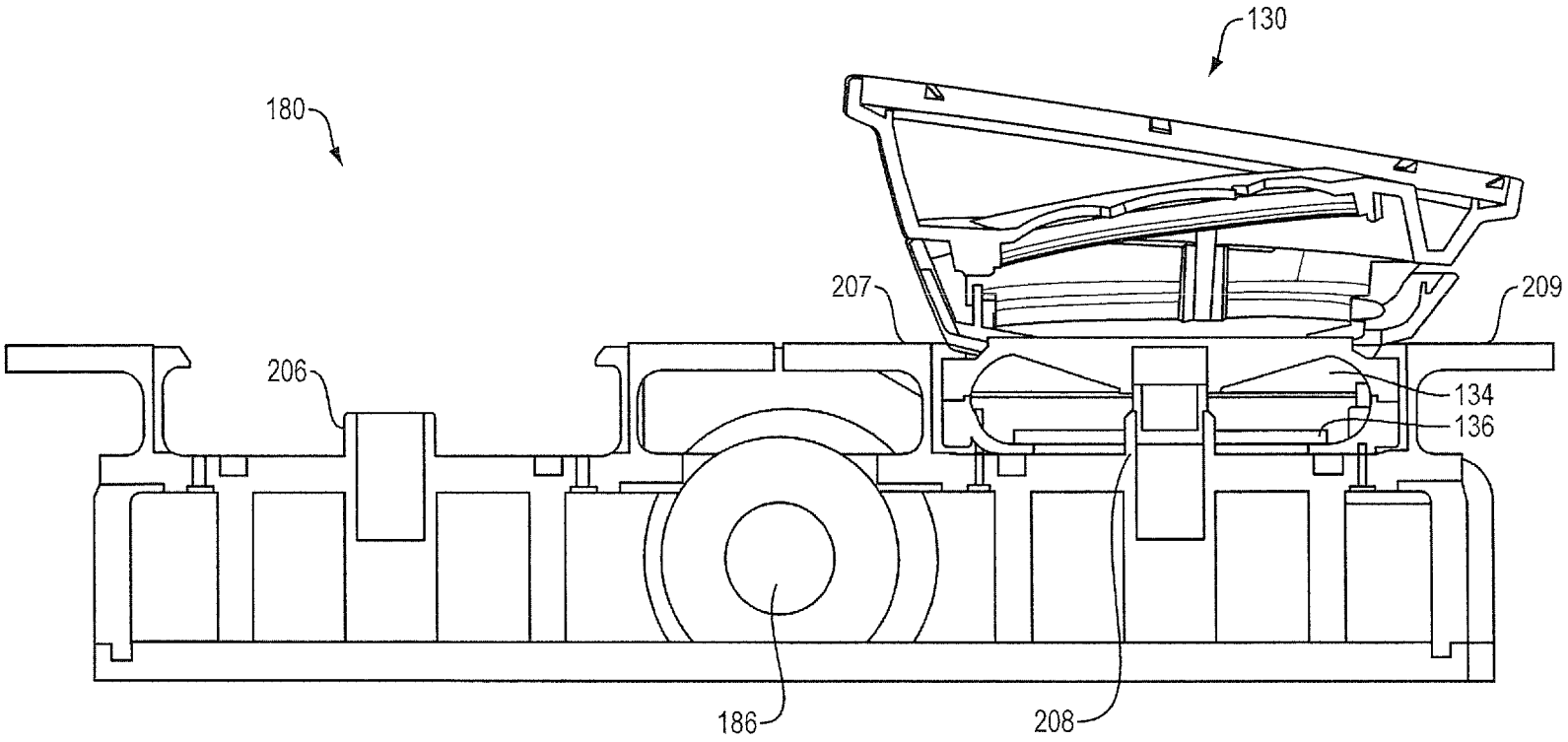

Headphones 130 are designed and configured to be coupled to headphone case 220 as shown in FIGS. 8A, 8B, 9A, 9B and 9C. Headphone case 220 includes lower portion 180 in which the headphones sit when stowed, and upper portion 222 that sits above the headphones when they are stowed. The case could be a clamshell case or have other configurations as would be known in the art. Upper wall 223 includes openings 224 and 226. Lower portion 180 has mechanical features that are designed to engage with and seat the two ear cups of the headphones. These features are best shown in FIGS. 9A and 9B. Posts 206 and 208 project upwardly from lower interior surface 182 and engage with and move the movable structures such as valves 136 that define part of the rear transducer cavities of headphones. In order to maintain the headphones in the proper stowed position, the case can include (but does not necessarily include) structures that interlock with the ear cups or otherwise hold the headphones in place in the case. In this non-limiting example structures for one ear cup comprise movable latches 200 and 201 and the structures for the other ear cup comprise movable latches 207 and 209. As shown in FIG. 9B these latches can engage the top of lower housing 133 that is shown in FIG. 7. Other arrangements to positively hold the ear cups in place in a headphone case are contemplated within the scope of this disclosure. Also, other means of moving the valves 136 are contemplated herein, including but not limited to mechanical structures other than those shown herein, or electromechanical devices.

FIG. 9B shows a single ear cup 146 latched into the headphone case via latches 207 and 209. The case is designed and arranged such that the ear pad of ear cup 146 would seal against the inside of top wall 222 just outside of and completely around opening 226, in the fashion shown in FIG. 5. A result is that sound produced by the headphone transducers will exit the case through openings 224 and 226. Also the rear cavity volume of the headphones is substantially increased by the entire empty interior volume of case 220. Port 186 with external opening 188 helps to tune the rear cavity as is known in the art. The case can also be configured without a port. Or, a passive radiator could be used instead of a port.

A number of implementations have been described. Nevertheless, it will be understood that additional modifications may be made without departing from the scope of the inventive concepts described herein, and, accordingly, other embodiments are within the scope of the following claims.

What is claimed is:

1. A convertible headphone system, comprising:

headphones comprising a transducer with a front and a rear, and a back cavity that is fluidly coupled to the rear of the transducer; and an external acoustic structure that defines an acoustic volume, wherein the external acoustic structure comprises a headphone case that is constructed and arranged to stow the headphones;

wherein the headphones and the external acoustic structure are configured to be coupled together so as to fluidly couple the back cavity of the headphones to the acoustic volume of the external acoustic structure, to form an expanded back cavity volume, wherein the headphone case has an interior volume that comprises the acoustic volume.

2. The convertible headphone system of claim 1 further comprising a movable structure that is coupled to the headphones and in part defines the back cavity, wherein the movable structure is constructed and arranged to be moved so as to alter the configuration of the back cavity.

3. The convertible headphone system of claim 2 wherein the headphone case comprises a mechanical device that is constructed and arranged to engage with and move the movable structure when the headphones are stowed in the headphone case.

4. The convertible headphone system of claim 3 wherein the mechanical device of the headphone case comprises protruding features that engage with and move the movable structure when the headphones are stowed in the headphone case.

5. The convertible headphone system of claim 4 wherein the protruding features comprise posts.

6. The convertible headphone system of claim 5 wherein the case comprises a lower portion in which the headphones sit when stowed, where the lower portion has a lower wall, and wherein the posts protrude into the interior volume of the case from the lower wall.

7. The convertible headphone system of claim 1 wherein the headphones comprise two ear cups and the headphone case has two openings, wherein each of the openings is aligned with one of the ear cups when the headphones are stowed in the case.

8. The convertible headphone system of claim 7 wherein when the headphones are stowed in the case the ear cups seal to the case around the openings.

9. The convertible headphone system of claim 1 wherein the headphone case comprises an audio port that comprises an opening from the interior volume of the headphone case to the outside.

10. The convertible headphone system of claim 1 wherein the headphones further comprise a shell that is spaced from the rear of the transducer and defines part of the rear cavity, wherein the shell is constructed and arranged to slide in and out relative to the transducer, so as to vary the volume of the rear cavity.

11. The convertible headphone system of claim 1 wherein the transducer comprises a driver that has a compliance that is equivalent to a volume of approximately 250 cc of air.

12. The convertible headphone system of claim 1 wherein the transducer comprises a driver that has a compliance that is equivalent to a volume of from about 75 cc to about 750 cc of air.

13. The convertible headphone system of claim 12 wherein the expanded back cavity volume is from about 75 cc to about 750 cc.

14. The convertible headphone system of claim 12 wherein a ratio of the driver compliance to the expanded back cavity volume is from about 0.5 to about 2.

15. A convertible headphone system, comprising:

headphones comprising two ear cups, each with a transducer that has a front and a rear, wherein a rear cavity is fluidly coupled to the rear of each transducer;

two movable structures that are coupled to the headphones such that they in part define the rear cavities, wherein the movable structures are constructed and arranged to be moved so as to alter the configuration of the rear cavities; and a headphone case that has an interior acoustic volume and is constructed and arranged to stow the headphones, wherein the case comprises mechanical devices that are constructed and arranged to engage with and move the movable structures when the headphones are stowed in the headphone case, so as to fluidly couple the rear cavities to the interior acoustic volume of the headphone case to create an expanded back cavity;

wherein each transducer comprises a driver that has a compliance that is equivalent to a volume of from about 75 cc to about 750 cc of air, and wherein a ratio of the driver compliance to the expanded back cavity volume is from about 0.5 to about 2.

16. A convertible headphone system, comprising:

headphones comprising two ear cups that each have an earpad, wherein the earpads are either circumaural earpads that are adapted to fit over the ears or supra-aural earpads that are adapted to sit on the ears, wherein each ear cup comprises a transducer that has a front and a rear, wherein a rear cavity is fluidly coupled to the rear of each transducer;

two movable valves, one coupled to each ear cup such that the valves in part define the rear cavities, wherein the movable valves are constructed and arranged to be moved so as to alter the configuration of the rear cavities;

wherein each transducer comprises a driver that has a compliance that is equivalent to an approximate volume of air, and wherein in the altered configuration the rear cavities have approximately the same volume as the transducer compliance; and a headphone case that has an interior acoustic volume and is constructed and arranged to stow the headphones, wherein the case comprises devices that are constructed and arranged to engage with and move the valves when the headphones are stowed in the headphone case, so as to fluidly couple the rear cavities to the interior acoustic volume of the headphone case to create an expanded back cavity;

wherein each transducer comprises a driver that has a compliance that is equivalent to a volume of from about 75 cc to about 750 cc of air, and wherein a ratio of the driver compliance to the expanded back cavity volume is from about 0.5 to about 2.

17. A convertible headphone system, comprising:

headphones comprising a transducer with a front and a rear, and a back cavity that is fluidly coupled to the rear of the transducer; and an external acoustic structure that defines an acoustic volume, wherein the external acoustic structure comprises a docking station;

wherein the headphones and the external acoustic structure are configured to be coupled together so as to fluidly couple the back cavity of the headphones to the acoustic volume of the external acoustic structure, to form an expanded back cavity volume.

18. The convertible headphone system of claim 17 wherein the headphones comprise a rechargeable battery, and wherein the docking station comprises a battery charger or a battery that is adapted to be electrically coupled to the headphones so as to be adapted to recharge the headphone battery when the headphones are coupled to the docking station.

19. A convertible headphone system, comprising:

headphones comprising a transducer with a front and a rear, and a back cavity that is fluidly coupled to the rear of the transducer; and an external acoustic structure that defines an acoustic volume;

wherein the headphones and the external acoustic structure are configured to be coupled together so as to fluidly couple the back cavity of the headphones to the acoustic volume of the external acoustic structure, to form an expanded back cavity volume;

wherein the transducer comprises a driver that has a compliance that is equivalent to an approximate volume of air, and wherein the expanded back cavity volume has approximately the same volume as the transducer compliance.

* * * * *